United States Patent [19]

Lederer

[11] Patent Number: 4,918,842

[45] **Date of Patent: * Apr. 24, 1990**

[54] SKI BOOT

[75] Inventor: Josef Lederer, Jetzendorf, Fed. Rep. of Germany

[73] Assignee: Salomon S.A., Annecy Cedex, France

[ * ] Notice: The portion of the term of this patent subsequent to Feb. 25, 2003 has been disclaimed.

[21] Appl. No.: 184,014

[22] Filed: Apr. 20, 1988

Related U.S. Application Data

[63] Continuation of Ser. No. 53,827, May 26, 1987, Pat. No. 4,759,137, which is a continuation of Ser. No. 926,100, Nov. 3, 1986, abandoned, which is a continuation of Ser. No. 815,177, Dec. 20, 1985, abandoned, which is a continuation of Ser. No. 561,635, Dec. 15, 1983, abandoned.

[30] Foreign Application Priority Data

Dec. 22, 1982 [DE] Fed. Rep. of Germany ..... 3247516

[51] Int. Cl.[5] ..... A43B 5/04

[52] U.S. Cl. ..... 36/117; 36/120

[58] Field of Search ..... 36/50, 117–121

[56] References Cited

U.S. PATENT DOCUMENTS

| | | | |
|---|---|---|---|
| 3,570,148 | 3/1971 | Morgan | 36/121 |
| 4,008,532 | 2/1977 | Kilbourn et al. | 36/120 |
| 4,083,129 | 4/1978 | Collombin | 36/117 |
| 4,095,356 | 6/1978 | Robran et al. | 36/121 |
| 4,160,332 | 7/1979 | Salomon | 36/119 |
| 4,190,970 | 3/1980 | Annovi | 36/50 |
| 4,408,403 | 10/1983 | Martin | 36/117 X |
| 4,449,274 | 5/1984 | Balbinot | 36/117 |
| 4,571,855 | 2/1986 | Blanc | 36/50 |
| 4,759,137 | 7/1988 | Lederer | 36/117 |

FOREIGN PATENT DOCUMENTS

| | | | |
|---|---|---|---|
| 0053340 | 6/1982 | European Pat. Off. . | |
| 3219772 | 1/1983 | Fed. Rep. of Germany | 36/120 |
| 3342331 | 5/1984 | Fed. Rep. of Germany . | |
| 2024700 | 8/1970 | France . | |
| 2433311 | 3/1980 | France . | |
| 2441353 | 6/1980 | France . | |
| 2480575 | 10/1981 | France . | |

*Primary Examiner*—James Kee Chi

*Attorney, Agent, or Firm*—Sandler, Greenblum & Bernstein

[57] ABSTRACT

In a ski boot having a toe- and heel-piece and an anklet consisting of an anklet front part and an anklet rear part it is proposed that the toe- and heel-piece is soft to deformation in the instep region in the direction of variation of the clear instep width, that the anklet front part is displaceable perpendicularly of a transverse axis on lateral articulation points on the side parts of the toe- and heel-piece, in the direction of variable action of the anklet front part along the instep line of the deformation-soft instep region of the toe- and heel-piece, and that tension means serving for the adjustment of the anklet front part on the articulation points act upon the anklet front part.

19 Claims, 15 Drawing Sheets

216
264
260
Q1
261
S
210
218
Q2
262
214
248
240a, 240b, 240c
212a
216a
V
250
250a
256d
256b
256
256a
256e
256c
256g
256f
246b
246
246a
VI

SKI BOOT

This is a continuation of application Ser. No. 053,827 filed May 26, 1987, now U.S. Pat. No. 4,759,137, 07-26-88 which is a continuation of application Ser. No. 926,100 filed Nov. 3, 1986, which is a continuation of application Ser. No. 815,177 filed Dec. 20, 1985, which is a continuation of application Ser. No. 561,635 filed on Dec. 15, 1983, all abandoned.

The invention relates to a ski boot including an outer boot and an inner boot, the outer boot comprising a toe-and heel-portion and an anklet. The anklet has an anklet front portion of an anklet rear portion pivotally mounted on the toe-and heel-portion. The anklet portions can overlap in the junction region and are tightenable by closing means. Means are also provided for adapting the instep width of the toe- and heel-portion to different individuals' feet.

Such a ski boot is known due to public prior use, in the home country, of a ski boot of the firm Nordica, Trident type. In this known form of embodiment the means for adaptation of the clear instep width of the toe- and heel-piece is formed by an air cushion of variable air pressure within the toe- and heel-piece.

In another Nordica form of embodiment, Posidon type, likewise known by public prior use in the home country, the instep width can be adapted to different foot forms in that in the region of the upper instep surface a support, plate of saddle form is fitted on the inner side of the toe- and heel-piece and can be adjusted by screw means from outside the toe- and heel-piece.

Finally in a known form of embodiment by the firm Salomon (SX 90), in which the forward part of the anklet is rigidly riveted with the toe- and heel-piece, it is known to adjust a saddle plate, which is fitted in the region of the instep upper surface within the toe- and heel-piece, through the intermediary of a wire draw cable which can be tightened on the back of the rear part of the anklet by a tightening lever.

Due to the installation of air cushions or mechanically displaceable saddle plates, the known forms of embodiment are more voluminous than is per se necessary with regard to the form of the foot. Thus they also become heavier and require an increased input of material. Furthermore the air cushions in the instep region and the pumps used for their pressure adjustment are trouble-prone and additionally space-consuming.

Mechanically adjustable instep saddle plates also suffer under the trouble-susceptibility of the means used for their adjustment.

The invention is based upon the problem, in a ski boot rendering possible a simplified adjustment of the instep width and of reducing the external volume of the ski boot.

Measures, in accordance with the present invention, are proposed for the solution of this problem.

It is not possible in all cases to arrange the tension means so that they lie in alignment with the instep line, so that the necessary tension force of the instep line of the forward part of the anklet, which is necessary to constrict the deformation-soft insetp arch of the toe- and heel-piece, cannot be generated directly. More especially in fact the danger exists that tension means arranged in such a way come to lie in that region of the toe- and heel-piece which must be reserved for the engagement of a binding. It is thus an object of the invention that the tension means may be placed outside this region and nevertheless the correct tension direction on the forward part of the anklet, namely the tension direction along its instep line, may be obtained.

One feature of the invention shows especially simple forms of articulations which permit adjustability of the anklet front part perpendicularly of the associated transverse axis.

Another feature of the invention shows serves for operational compatibility of the ski boot in contrast to known solutions where a correspondingly soft anklet is unilaterally disengageable from an articulation and can then be bent far out, in which case however the anklet had to be of soft formation with regard to the outward flexibility, which is again objectionable for reasons of foot guidance.

Another feature of the invention shows a simple and effective solution for the deflection of the tension force.

The present invention provides adequate space for the accommodation of the tension means.

An additional feature of the invention promotes comfort for the skier in the putting on and taking off of the ski boot.

Still another feature of the invention reduces the number of the necessary tightening elements and thus cheapens the boot and at the same time increases comfort in putting on and taking off.

According to another feature of the invention the forward shift limiting means desired with regard to the downhill running function can readily be used in the boot design according to the invention. Here these have the special advantage that they readily adapt themselves to the instep constricting movement of the front part of the anklet.

In one aspect of the invention on the one hand promotes comfort in slipping on and off and at the same time contributes to stabilisation of the anklet about the transverse axes.

The available slip-on and slip-off width can also be increased. Moreover the possibility exists of being able to adapt the heel width to the foot of each wearer, provided that the toe- and heel-piece possesses a certain deformation-softness caused by material or design, in the heel region too.

In one embodiment of the invention, the adjustment of the anklet rear part, can be transferred to the closing means and tension means.

In a ski boot designed in accordance with the invention a rear shift limiting device can be provided which is desired for downhill running technique. It here proves a special advantage of the concept in accordance with the invention that the rear shift limiting device can be set out of action in a simple manner, which is conducive on the one hand to slipping on and off, on the other hand to comfortable walking without the ski.

Even if the anklet rear part is not displaceable as a whole transversely of the pertinent transverse axis, it is still possible to set the rear shift limiting device out of action.

The softness to deformation of the toe- and heel-piece in the region of the instep surface, required according to the invention, can be achieved.

One feature of the toe- and-heel-portion ensures comfortable slipping on and off of the boot.

The inner boot may be fixed in the outer boot and ensures that after the foot has been slipped out the rearward part of the inner boot positively returns into the normal position in common with the rearward part of the toe- and heel-piece.

In an additional feature of the invention, the softness to deformation of the toe- and heel-piece in the instep surface region promotes on the one hand easy slipping of the foot in and out and on the other hand adaptation of the boot to different instep depths of the wearers.

Another aspect of the invention provides a preferred manner of mounting of the anklet front part on the toe- and heel-piece in the sense of a shift of the instep region of the anklet front part over the instep region of the toe- and heel-piece.

In this connection this feature supplies a favourable introduction of force leading to a tension in the instep line of the anklet front part.

Another feature substantially relieves the joint links of bending forces.

A still further feature ensures a synchronous movement of the anklet front part forwards and of the anklet rear part rearwards when the tension means are released, whereby on the one hand slipping in and out of the foot is facilitated and on the other hand any co-operating stops for the rearward shift limitation are positively shifted away from one another.

An additional feature ensures a protected position of the articulation link and a good appearance of the boot.

Another aspect ensures a stabilisation of the articulation link, so that without danger of bending it can be made from thin-walled material and is not bulky.

Another aspect ensures reliable control of the stops co-operating for rearward shift limitation, in the sense that these positively come out of engagement on release of the tension means, and liberate the rearward movement beyond the limit position.

A still further aspect permits a variation of the rearward shift limitation in adaptation to individual requirements of the skier.

An added feature of the invention transfers the adjustment of the rearward shift limitation to the resilient bearer.

Another embodiment provides an alternative solution for the problem of the positive disengagement of the stops from one another which effect the rearward shift limitation.

Another embodiment shows one possibility of being able to adjust the tension of the tension means to the individual foot form.

Another embodiment discloses a device having the fewest possible cable anchorages suffice.

Another embodiment shows a tackle-block-type effect which in the opening of the tightening device leads to a considerable slackening in the tension means with the consequences that the anklet rear part can be turned far out.

An additional feature of the invention facilitates the putting on and taking off of the boot and the conversion from downhill position to walking position for the skier.

An additional feature represents a simple possibility of tightening and relaxing upper closing means and lower closing means, which may act as tension means, at the same time with an ordinary tightener device at mid height of the anklet.

In a still further aspect of the invention solution is obtained which especially facilitates the tightening of the closing and possibly the tension means for the skier.

Detent means are another feature of the invention. These detent means become effective and ineffective respectively in tightening and relaxing, without additional expenditure of operating action.

An additional embodiment provides for adaptation of the ski boot to different instep forms of individual foot forms. The idea here is especially that in the first fitting of the ski boot on the wearer in the sales premises different instep cushions can be inserted according to foot form. The advantage of adaptation of the instep width by the measures of the claims is not restricted or eliminated thereby. The different instep cushions lead to no substantial increase of volume of the ski boot and are unobjectionable as regards fitting and actuation.

The invention is explained by reference to examples of embodiment by the accompanying Figures, wherein:

FIG. 15 represents a partial section along the line XV—XV in FIG. 11;

Figure 1:
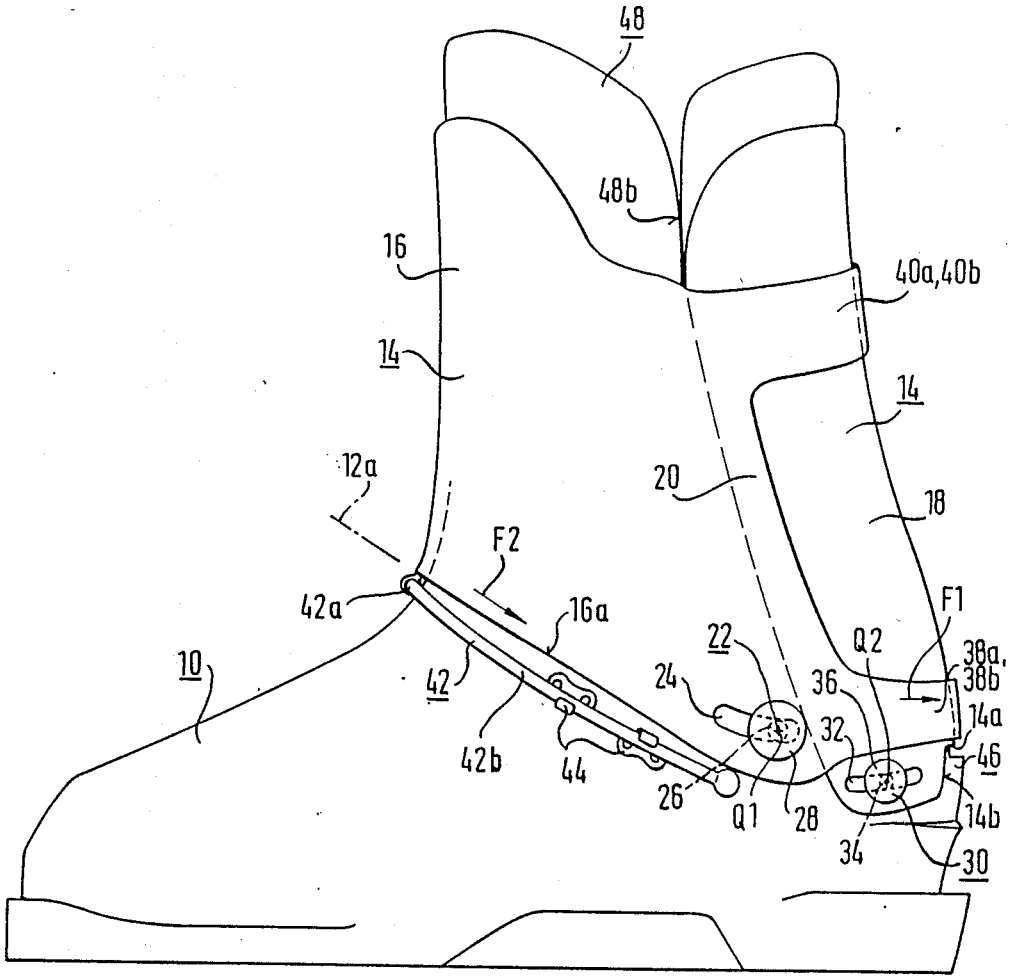
FIG. 1 represents a lateral elevation of a ski boot according to the invention.
Figure 2:
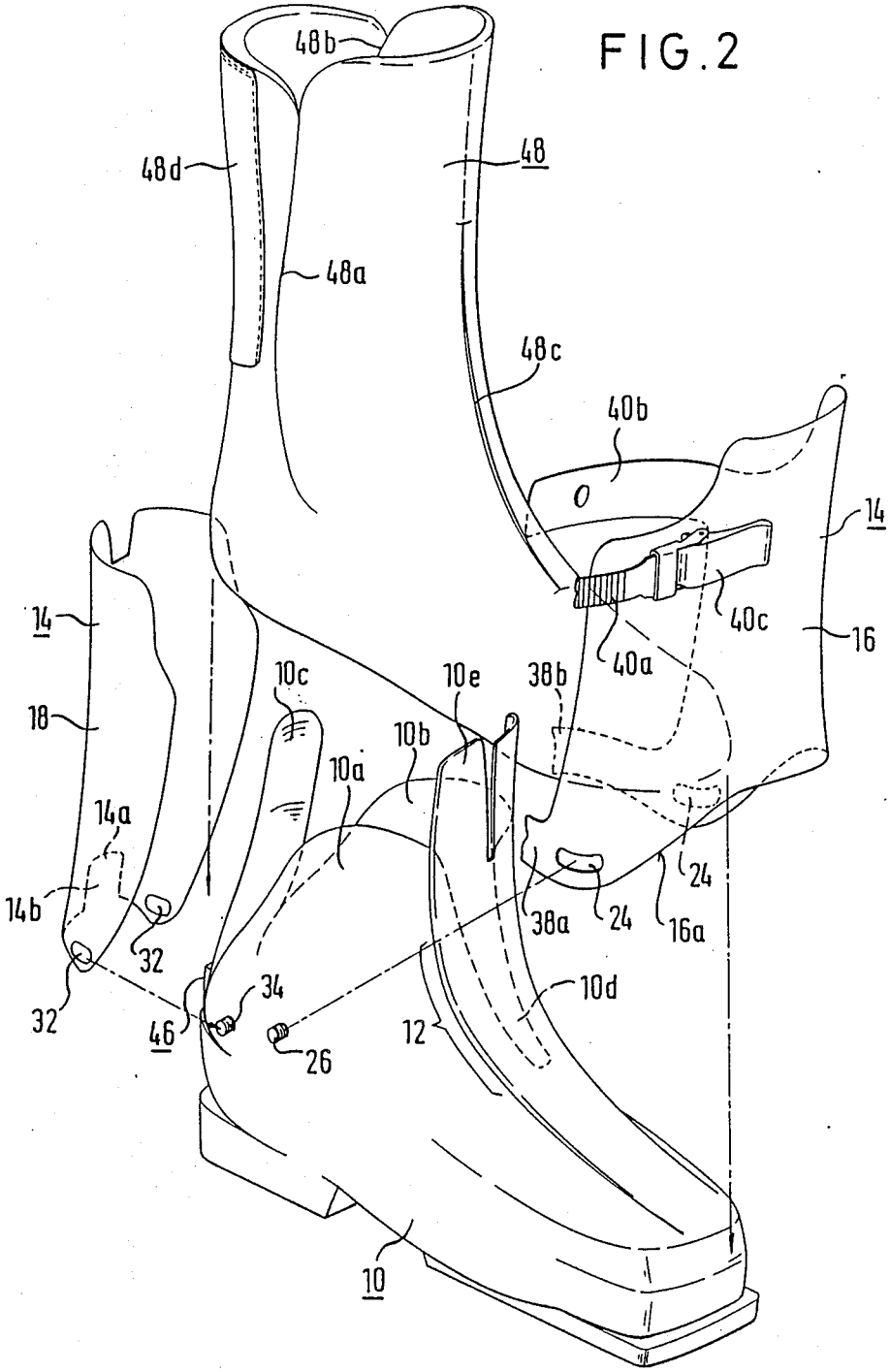
FIG. 2 represents an exploded illustration of FIG. 1, the curved spring bar being omitted.

In FIGS. 1 and 2 a toe- and heel-piece is designated by 10. This toe- and heel-piece possesses side parts 10*a* and 10*b* and a rear flap 10*c*. Between the side parts 10*a* and 10*b* a slot 10*d* is formed which is covered by a tongue 10*e*. The toe- and heel-piece 10 is produced in one piece with the parts 10*a*, 10*b*, 10*c*, 10*d* and 10*e* from synthetic plastics material or rubber-like material, for example by injection-moulding. While the side parts 10*a* and 10*b* are relatively stiff, the flap 10*c* can easily be deflected out to the rear with a view to entry into the ski boot from behind. In FIG. 2, 12 indicates the instep surface which is formed by the side parts 10*a*, 10*b* and the tongue 10*e*. The instep surface 12 is made soft to deformation by the slotting at 10*d*, so that it can be adapted to individual foot forms. Moreover in slipping on and off the side parts 10*a* and 10*b* can be spread apart from one another, and the tongue 10*e* can be raised with the side parts 10*a* and 10*b*.

An anklet 14 is formed by an anklet front part 16 and an anklet rear part 18. These anklet parts 16 and 18 overlap in the closed condition as indicated at 20. The two anklet parts 16 and 18 are injection-moulded, like the toe- and heel-piece, from relatively stiff synthetic plastics or rubber material. The anklet front part 16 is mounted pivotably about a transverse axis Q1 by bolt-slot articulations 22 on the side parts 10*a* and 10*b* of the toe-and heel-piece 10. The bolt-slot connections 22 are formed by slots 24 in the anklet front part 16 and bolts 26 on the side parts 10*a* and 10*b* of the toe- and heel-piece 10. Cap nuts 28, (FIG. 1), which are screwed on to the bolts 26 and rest on the material of the front part 16 beside the slots 24, do not serve for securing the anklet front part. The cap nuts 28 cannot be released by the skier in operation.

The anklet rear part 18 is articulated pivotably about a transverse axis Q2 on the toe- and heel-piece 10 by bolt-slot articulations 30. The bolt-slot articulations 30 are formed by substantially horizontal slots 32 in the anklet rear part and bolts 34 on the side parts 10*a*, 10*b* of the toe- and heel-piece 10, and cap nuts 36 are seated on the bolts 34.

Tension strap pieces 38*a*, 38*b* are connected or produced integrally with the anklet front part 16, and run over the anklet rear part 18 and can be tightened by a tension buckle or the like. The tension buckle is not illustrated. Furthermore the anklet front part 16 is connected or produced integrally with closing straps 40*a*, 40*b* which can be closed and tightened by a closing buckle 40*c* so that the anklet 14 can be tightened around the ankle.

The slots 32 extend substantially horizontally while the slots 24 are curved, namely with a downwardly convex course of curvature, while the end section of the slot 24 on the left in FIG. 1 tangentially approaches a parallel to the instep line 12*a*. The lower edge 16*a* of the anklet front part 16 extends along the instep line 12*a* which passes approximately through the middle of the length of the instep surface 12. On tensioning of the tension strap pieces 38*a* and 38*b* a tension force F1 acts upon the anklet front part 16. However thanks to the bolt-slot connections 22 this tension force F1 is converted into a tension force F2 which acts approximately parallel to the instep line 12*a* and renders possible a constriction of the instep surface 12 in adaptation to the instep height of the skier in each case.

In corresponding manner the tension force F1 in the tension strap pieces 38*a*, 38*b* draws the rear anklet part 18 on to the heel region of the toe- and heel-piece 10 so that this region too, if it is made correspondingly soft, is adaptable to the heel form.

On opening of the tension strap pieces 38*a*, 38*b* and of the closing strap pieces 40*a*, 40*b*, apart from the pivoting movements the anklet front part 16 can slide forwards and upwards and the anklet rear part 18 can slide rearwards, so that slipping in of the foot substantially from rearwards becomes possible. Due to the forward displacement of the anklet front part 16 it becomes possible for the side parts 10*a*, 10*b* and the tongue 10*e* to yield before the entering foot. In the slipping in of the foot the anklet rear part 18 can be hinged far away to the rear. The flap 10*c* can follow this rearward hingeing movement of the anklet rear part 18.

When the tension strap pieces 38*a*, 38*b* and the closing strap pieces 40*a*, 40*b* are closed, then thanks to the offsetting of the transverse axes Q1 and Q2 and the connection of the anklet parts 16, 18 by way of the tension strap pieces 38*a*, 38*b* and the closing strap pieces 40*a*, 40*b*, a partial stabilisation of the anklet 14 is already given. With a view to an elastic forward positional supporting a curved spring bar 42 is fitted, as may be seen from FIG. 1, on the toe- and heel piece 10, and is supported by hooks 44 on the toe- and heel-piece so that its apex 42*a* can be bent away forwards and downwards only by elastic bending of the sides 42*b*. The apex 42*a* of the curved spring bar 42 acts on the anklet front part 16 in the apex region of the instep line 12*a* so that the anklet front part 16 is elastically supported against forward shifting about the transverse axis Q1. The curved spring bar 42 is displaceable in the hooks 44, so that it can follow the adaptation movement of the anklet front part 16 in the bolt-slot articulations 22.

A rearward shift limiting stop 46 is fitted on the toe- and heel-piece 10 in the heel region and co-operates with the edge 14*a* of a cut-away portion 14*b* in the anklet rear part 18, limiting the rearward shift movement, as the tension strap pieces 38*a*, 38*b* are tightened. If on the other hand the tension strap pieces 38*a*, 38*b* are slackened, the anklet rear part 18 can yield rearwards in FIG. 1 so far that the edge 14*a* can be pivoted away over the rearward shift limiting stop 46. This is advantageous with regard to a wide pivotability away of the anklet rear part 18 in the slipping in of the foot and in walking with the ski boot without the ski.

Details of the inner boot 48 too are seen in FIG. 2. This inner boot 48 is provided with lateral slots 48*a* and 48*b* which facilitate the slipping in of the foot. Furthermore the inner boot is provided in the region of the front tendon with a slot 48*c* which permits spreading open in the region of the instep surface 12, especially in the slipping in and out of the foot.

In the Achilles tendon region a pocket 48*d* is sewn on to the inner boot 48 and can receive the flap 10*c*, so that the seating of the inner boot 48 in the toe- and heel-piece 10 is improved.

Figure 3:
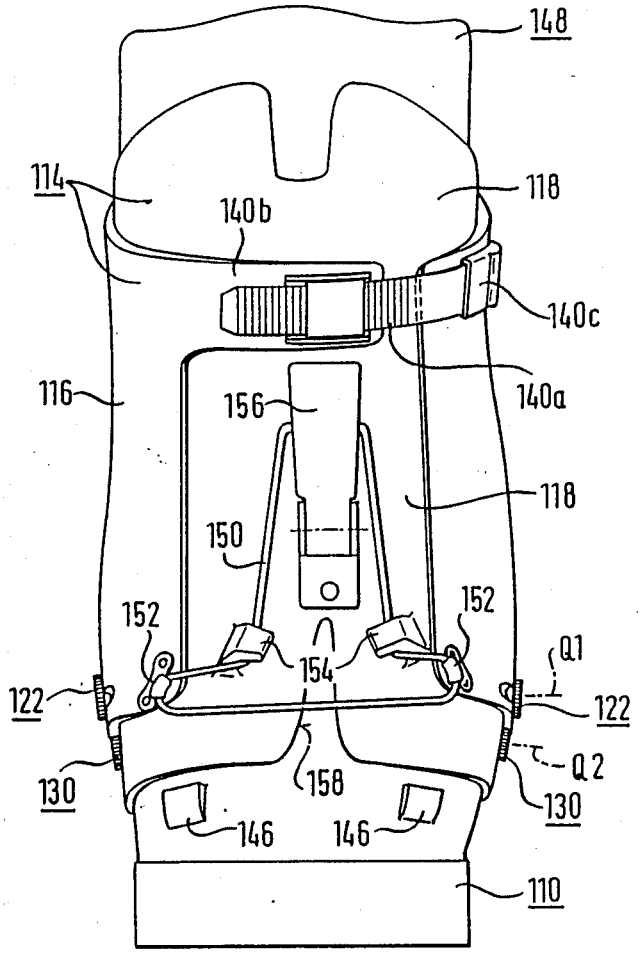
FIG. 3 represents a rear view of a further form of embodiment.

In FIG. 3, analogous parts are provided with the same references as in FIGS. 1 and 2, increased in each case by the number 100.

In this form of embodiment displaceability in the articulations 130 is forgone. The lower edges of the anklet rear part 118 here co-operate with the rearward shift limiting stope 146. As tension means a cable loop 150 is provided which is hooked into hooks 152 of the anklet front part 116 and leads over deflection points 154 on the anklet rear part 118 to a buckle 156. The buckle 156 lies just as high as permitted by the closing strap pieces 140*a*, 140*b*, so that they can be reached conveniently. After the buckle 156 is released the tension loop 150 can be disengaged from the deflection points 154, so that a great loop length is available, permitting extensive pivoting out of the anklet rear part 118. Moreover on release of the buckle 156 the lower edges of the anklet rear part 118 on both sides of a slot 158 of the anklet rear part 118 lift away so far from the toe- and heel-piece that they can pass over the rearward shift limiting stops 146.

In FIGS. 4 to 7 analogous parts are provided with the same references as in FIGS. 1 to 3, each increased by 100 or 200.

In the form of embodiment according to FIGS. 4 to 7 the anklet front part 216 is articulated at the transverse axis Q1 by articulation points 260 to articulation links 261 which in turn are articulated pivotably about a pivot axis S to the toe- and heel-piece 210. The articulation links 261 extend in the tensioned condition, as may be seen from FIG. 4, substantially perpendicularly to the instep line 212*a*. The free ends of a draw cable 250 engage articulatedly at the articulation points 260. The draw cable 250 forms a loop 250*a*, which extends 256*a* through the actuating lever 256*b* of the tightening device 256. The actuating lever 256 is mounted on an articulation block 256*c* which in turn is arranged on a carrier spring 256*d*, namely vertically displaceably in the direction of the double arrow 256*e*. The carrier spring 256*d* forms at its lower end a counter-stop 256*f* for co-operation with the rearward shift-limiting stop 246. The rearward shift-limiting stop 246 comprises a fitting plate 246*a* and a stop element 246*b* vertically adjustably thereon. Beneath the carrier spring 246*d* at its lower end there is arranged a winding block 256*g* for the cable loop 250*a*.

The anklet rear part 218 is mounted pivotably beneath the anklet front part 216 in the transverse axis Q2 of the toe- and heel-piece 210, and slots can be provided there by way of example. As may be seen from FIG. 5, in the case of the example the transverse axis Q2 is formed by pivot pins 262 produced integrally with the toe- and heel-piece 210 and engaging in apertures 264 of the anklet rear part. This results in an especially simple form of the mounting which can be secured exclusively by the application of the anklet front part 216 but is also releasable when the anklet front part 216 is correspondingly spread apart from the toe- and heel-piece.

Figures 4, 5:
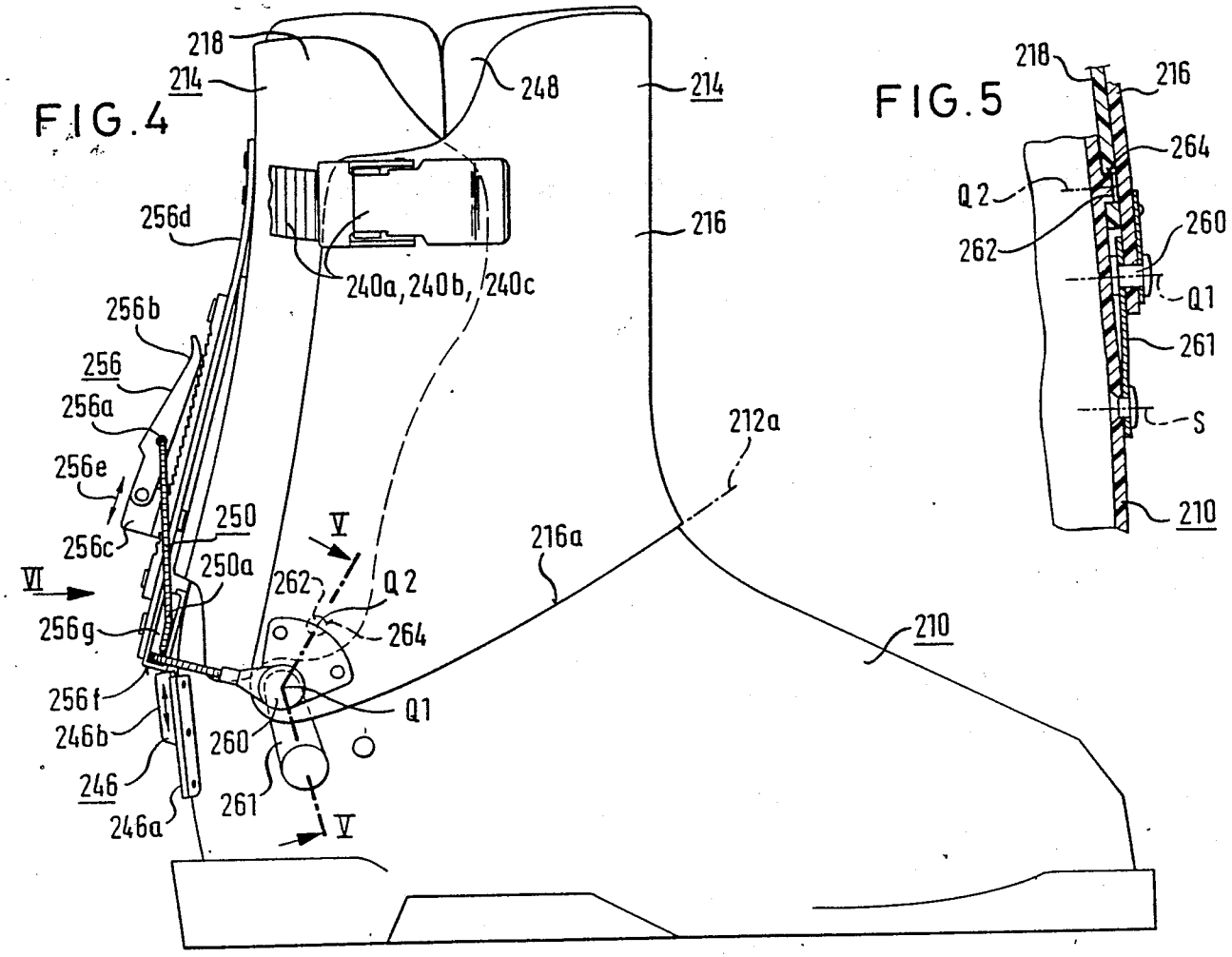
FIG. 4 represents a lateral view of a third form of embodiment in which the anklet front part is mounted by articulation links on the toe- and heel-piece.
FIG. 5 represents a section along the line V—V in FIG. 4.
Figure 6:
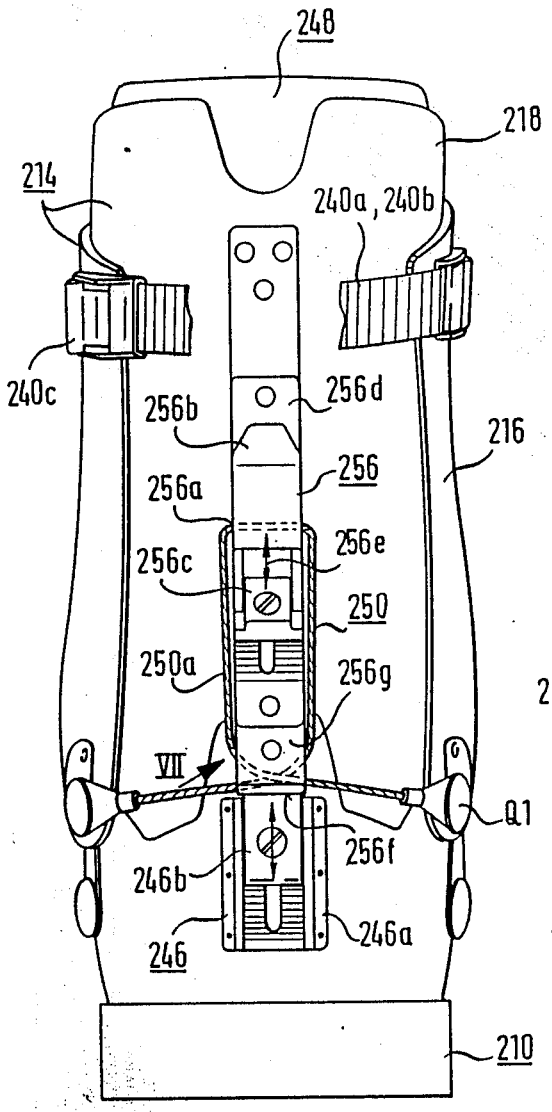
FIG. 6 represents a rear view of the form of embodiment according to FIG. 4.
Figure 7:
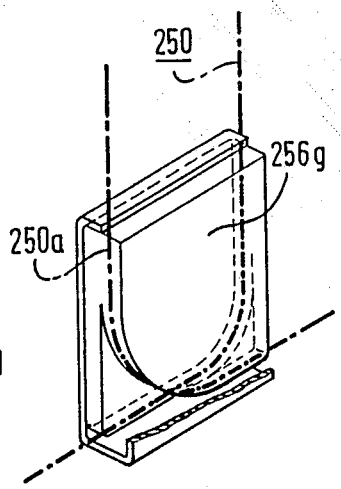
FIG. 7 represents a partial view in the direction of the arrow VII in FIG. 6.

When the actuating lever 256*b* in FIG. 4 is pivoted downwards in the counter-clockwise direction, by reason of the loop 250*a* a considerable slackening of the draw cable 250 occurs so that the pivot links 261 can pivot out far in the clockwise direction according to FIG. 4 and the anklet front part 216 can shift correspondingly far forward. At the same time on account of the slackening of the draw cable 250 it becomes possible to pivot the anklet rear part 218 far to the rear. It should also be noted here that on slackening of the draw cable 250 the carrier spring 256*d* lifts itself away from the anklet rear part 218 so that the counterstop 256*f* comes out of the range of action of the rear shift-limiting stop 246*b*. This is important not only for the taking off and putting on of the boot, but also for walking without the ski. The rear shift end position can be modified by displacement in height of the stop element 246*b* in relation to the fitting plate 246*a*. In putting on the ski boot the wearer needs only to move with his lower leg into the forward position so far that on subsequent tightening of the actuating lever 256*b* the counter-stop 256*f* comes into its position of action above the stop element 246*b*.

By a height displacement of the articulation block 256*c* along the carrier spring 256*d* the tightening effect of the tightening device 256 can be modified and adapted to individiual foot forms. It is to be noted that the rearward movement end position and the tension effect can be adjusted independently of one another.

Figure 9:
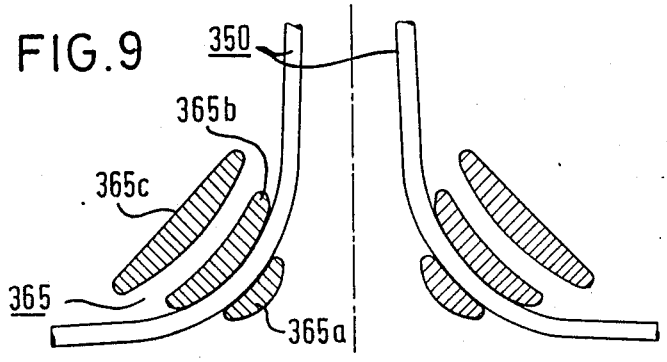
FIG. 9 represents a detail at IX in FIG. 8.

The forms of embodiment in FIGS. 8 and 9, in which analogous parts are again provided with the same references as in FIGS. 4 to 7, increased in each case by the number 100, differ from the above-described form of embodiment in the following:

The carrier spring 356*d* is adjustable in height in relation to the anklet rear part 318, as indicated by the arrow 356*h*. As before the articulation block 356*c* is also adjustable in height in relation to the carrier spring 356*d*. Therefore no vertical displaceability of the rearward shift-limiting stop 346 is necessary any more for the adjustment of the rearward position, so that this stop can be produced in one piece with the toe- and heel-piece.

Furthermore the draw cable 350 is conducted without loop over deflector dogs 365 of the toe- and heel-piece 310 and can be unhooked from these so that here again a substantial slackening of the draw cable is to be expected in release of the actuating lever 356 from its tightening position. Moreover the effective cable length of the draw cable 350 can be modified by its insertion into different dogs 365*a, b, c*, as may be seen from FIG. 9.

Figure 10:
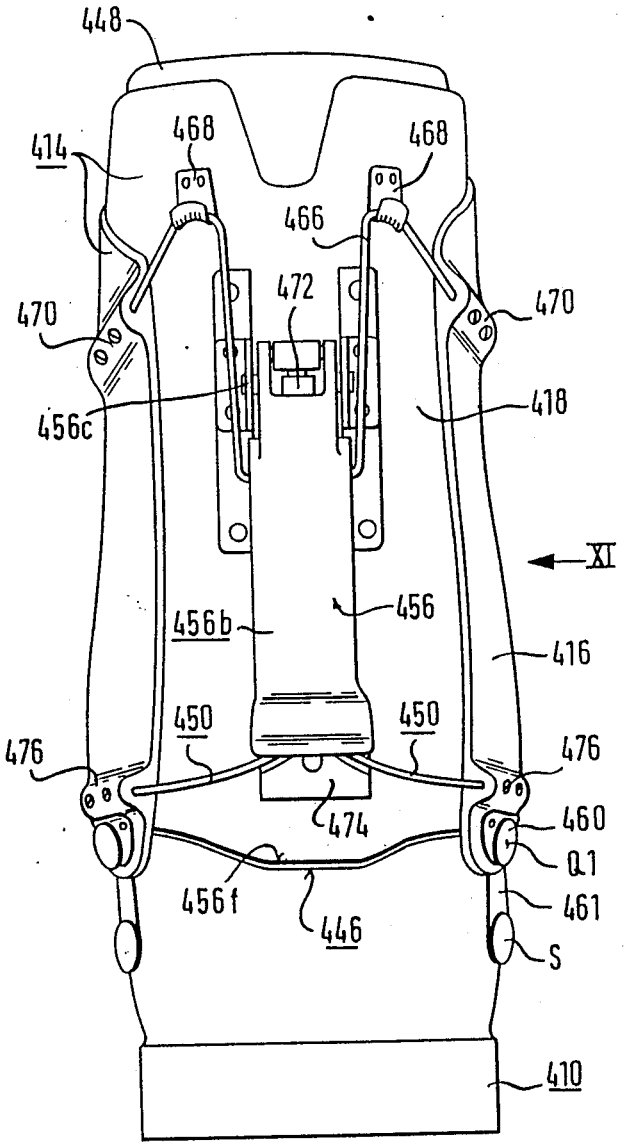
FIG. 10 represents a fifth form of embodiment in rear view with a common tightening device for the tension means provided in the lower anklet region and the closing means provided in the upper anklet region.
Figure 11:
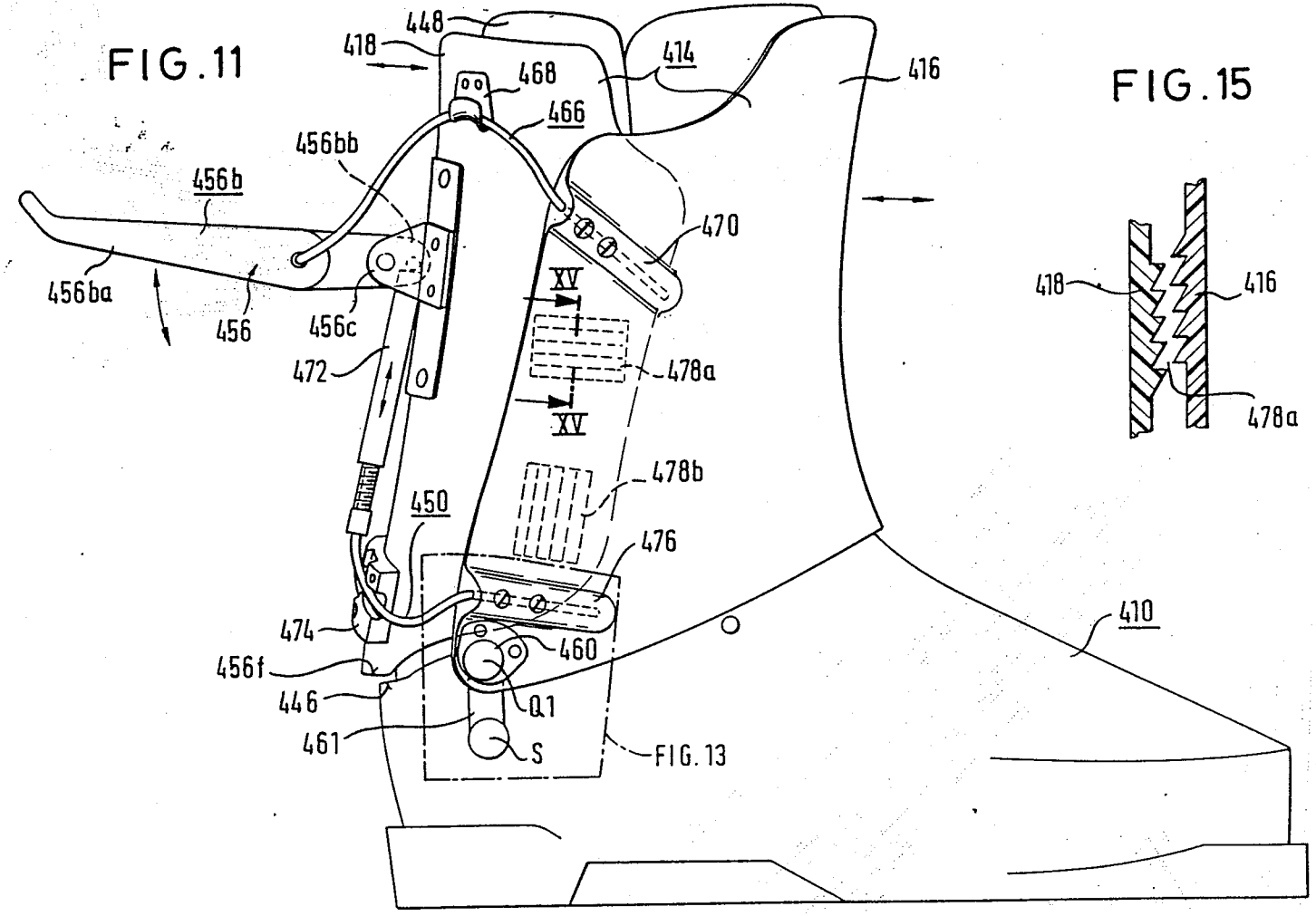
FIG. 11 represents a lateral view of FIG. 10, seen in the direction of the arrow XI in FIG. 10.

The form of embodiment according to FIGS. 10 and 11 differs from the forms of embodiment hitherto especially in that a single tightening device 456 is provided in order to draw the anklet front part 416 to the rear in the instep region and at the same time to close the anklet as a whole in the upper region.

The actuating lever 456*b* is made with two arms in relation to the articulation point on the articulation block 456*c*. A closing cable 466, which extends over deflector hooks 468 on the anklet rear part 418 to anchorage points 470 of the anklet front part 416, engages with the actuation-side arm 456*ba*. A draw bar 472, from the lower end of which a draw cable 450 leads over a forked deflector block 474 to each of anchorage points 476 of the anchored front part 416, engages with the actuation-remote arm 456*b-b* of the actuating lever 456*b*. The draw cables 466 and 450 are clamped fast in the anchorage points 470 and 476 by clamping screws and can be readjusted there. By hingeing downwards of the actuating lever 456*b* in FIG. 11 the closing cable 466 and the draw cables 450 are equally tightened. An individual variation of the tightening force is possible by adjustment of the cable ends and the anchorage points 470 and 476. In addition the draw bar 472 is variable in length.

The anklet rear part 418 can again be adjustable in this form of embodiment by slots on the toe- and heel-piece 410, so that after release of the actuating lever of the tightening device 456 it can move to the rear and the rearward shift-limiting step 446 fitted on the toe- and heel-piece 410 no longer co-operates with the counter-stop 456*f*.

It should be determined at this point that the actuation of the tension cables 450 and of the closing cables 466 by one single actuating lever is not necessarily confined to the presence of mobility of the transverse axis Q1, but is to be placed under protection independently thereof.

In the region of overlap of the anklet front part 416 and rear part 418 detents 478*a* and 478*b* are arranged which, as may be seen from FIG. 15, are made in sawtooth form so that when the anklet parts are drawn together they slide over one another and after reaching the end position can snap into one another. The detent 478*a* then makes the overlapping anklet parts fast in relation to one another in the vertical direction, while the detent 478*b* makes these anklet parts fast in relation to one another in the longitudinal direction of the boot.

Otherwise analogous parts in FIGS. 10, 11 and 15 are also provided with the same references as in the preceding Figures, only the first digit being increased in each case to 4.

Figure 12:
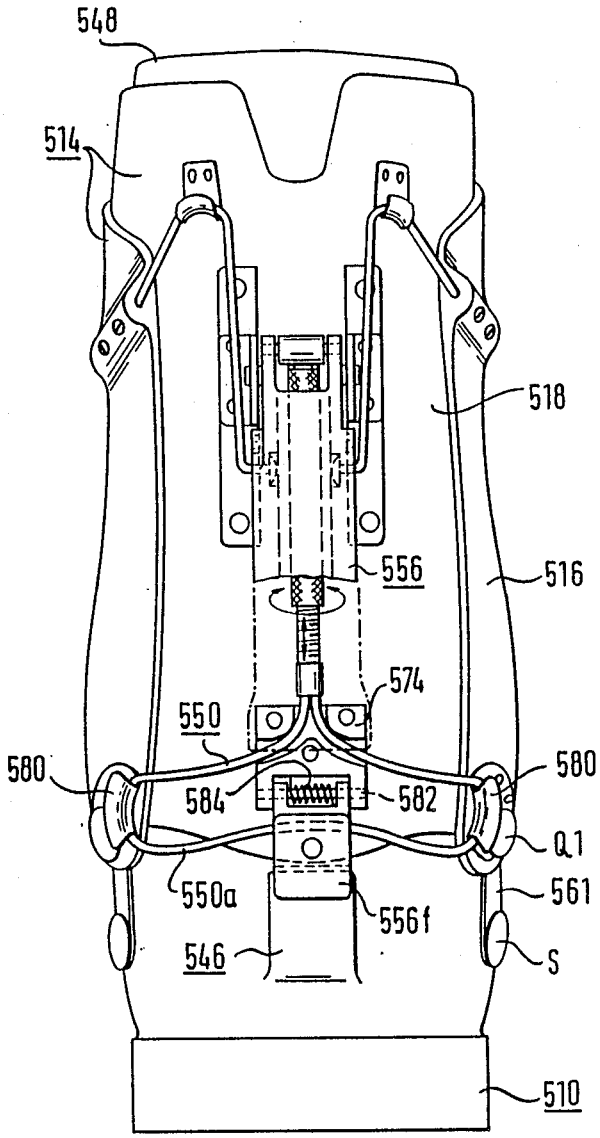
FIG. 12 represents a modification of FIG. 10 concerning the tension means.

The form of embodiment according to FIG. 12 differs from that according to FIGS. 10 and 11 merely in that in place of the two draw cables 450 there is a draw cable loop 550 which acts on a hook 580 in each case of the anklet front part 516. The lower section 550*a* of the draw cable loop 550 extends over a counter-stop element 556*f* which is mounted pivotably on the deflector block 574 about an articulation axis 582 and is initially stressed through a helical torsion spring 584 in the direction of lifting away from the toe- and heel-piece 510. In the tightening of the tightening device 556 the counter-stop element 556*f* is pivoted against the spring action of the helical torsion spring 584 into its operative position in relation to the rearward shift-limiting stop 546.

Otherwise the form of embodiment according to FIG. 12 corresponds to that according to FIGS. 10 and 11; analogous parts are provided with the same references each further increased by the number 100.

Figure 14:
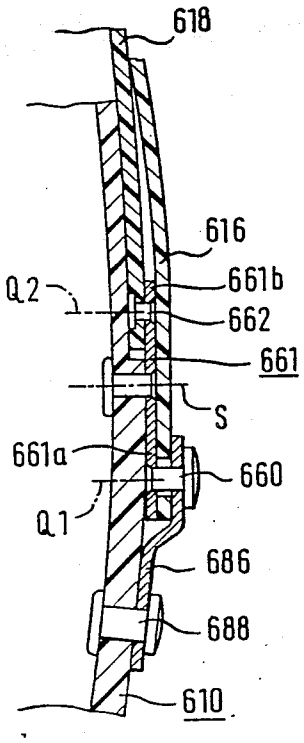
FIG. 14 represents a seciton along the line XIV—XIV in FIG. 13.
Figure 13:
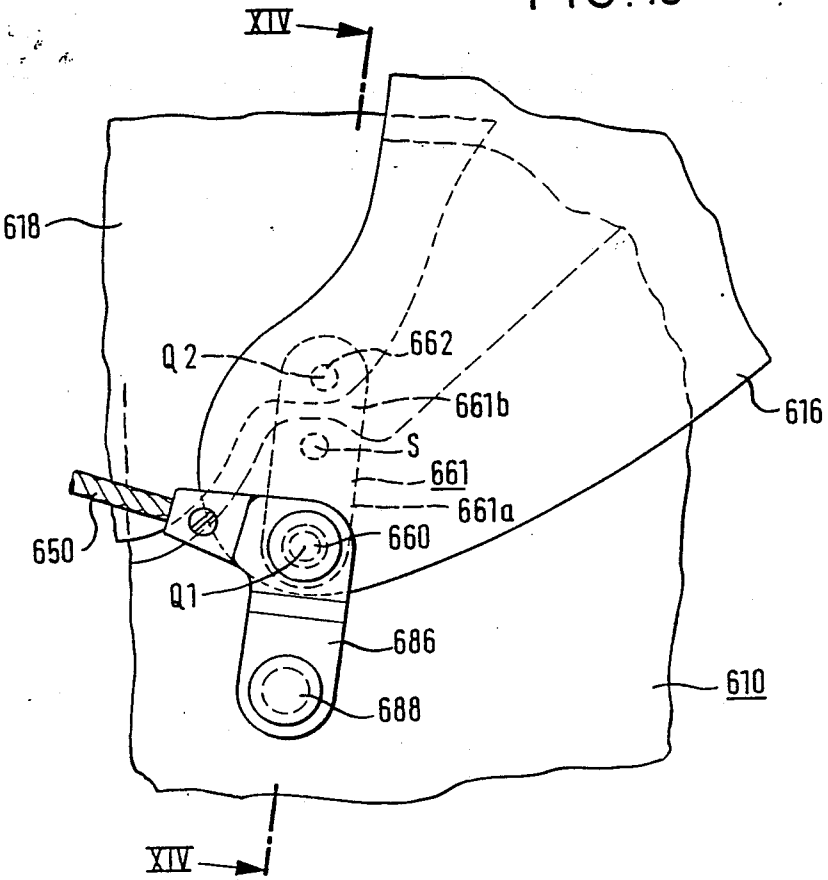
FIG. 13 represents a sixth form of embodiment, namely a detail view thereof in the region indicated in FIG. 11 by the dot-and-dash outline.

In FIGS. 13 and 14 a further form of embodiment is illustrated which differs from the forms of embodiment according to FIGS. 4 to 12 in that the articulation link 661 is formed as a two-armed articulation link, the anklet front part 616 being connected at the articulation point 660 with the one arm 661*a* of the articulation link 661, forming the transverse axis Q1, while the anklet rear part 618 is connected at an articulation point 662 with the other arm 661*b* of the articulation link 661, forming the transverse axis Q2. The double-armed articulation link 661 is mounted pivotably on the toe- and heel-piece 610 at the pivot axis S.

The draw cable 650 engages with the double-armed articulation link 661 in the region of the articulation point 660. If the draw cable 650 is tightened, the anklet front part 616 is drawn to the rear and the anklet rear part 618 is drawn forwards.

The articulation link 661 is stabilised by a support link 686 which is mounted pivotably at an articulation point 688 on the toe- and heel-piece 610 and is articulatedly connected at the articulation point 660 with the arm 661*a* of the articulation link 661, namely with appropriate bearing play in order to prevent self-locking of the articulation link 661 and the support link 686. FIG. 14 here shows the mutual association of the anklet parts 616, 618, the toe- and heel-piece 610, the articulation link 661 and the support link 686. It is seen that the anklet rear part 618 lies beneath the anklet front part 616 in a recess of the toe- and heel-piece 610, that the articulation link 661 lies with the arm 661*b* between the anklet front part 616 and the anklet rear part 618 and with the arm 661*a* between the toe- and heel-piece 610 and the anklet front part 616. A cranked formation of the support link 686 is also seen.

Figure 16:
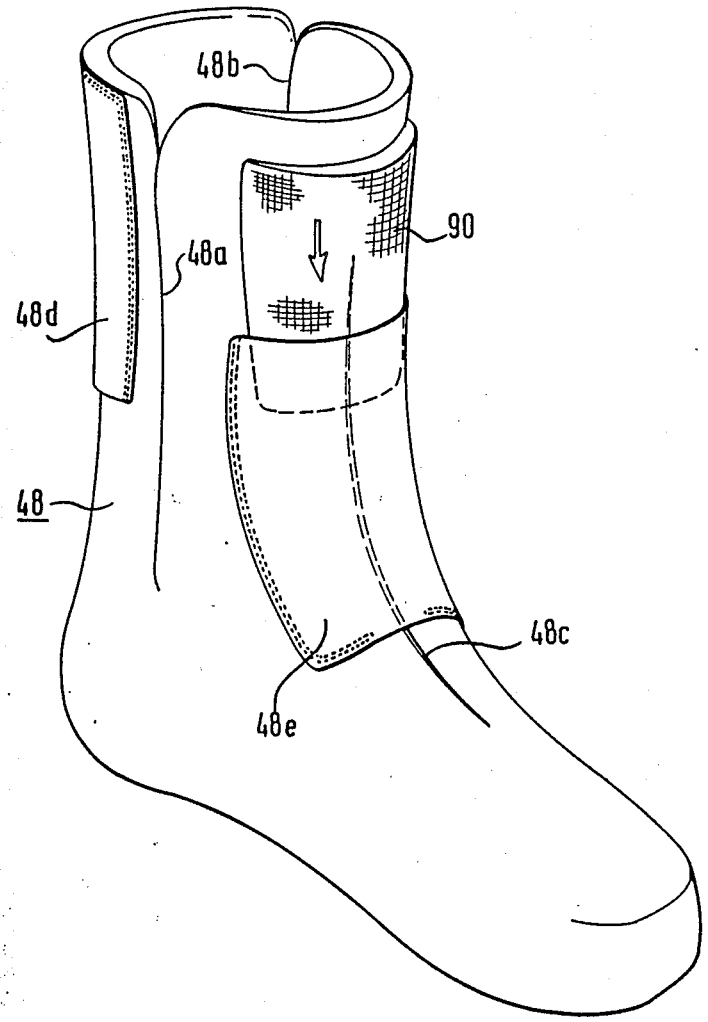
FIG. 16 represents a further inner boot with an instep cushion.

Each of the tightening devices as illustrated in the preceding Figures can be used to tighten the draw cable 650. Moreover each of the rearward shift-limiting devices as represented in the preceding Figures can be utilised. In FIG. 16 it is shown that a pocket 48*e* is fitted on the instep region of the inner boot 48, in which pocket instep cushions 90 of different thicknesses can be inserted for adaptation to different foot forms. In this way an additional adaptation of the ski boot in the instep region to the existing anatomical conditions of the individual foot is possible.

Figure 8:
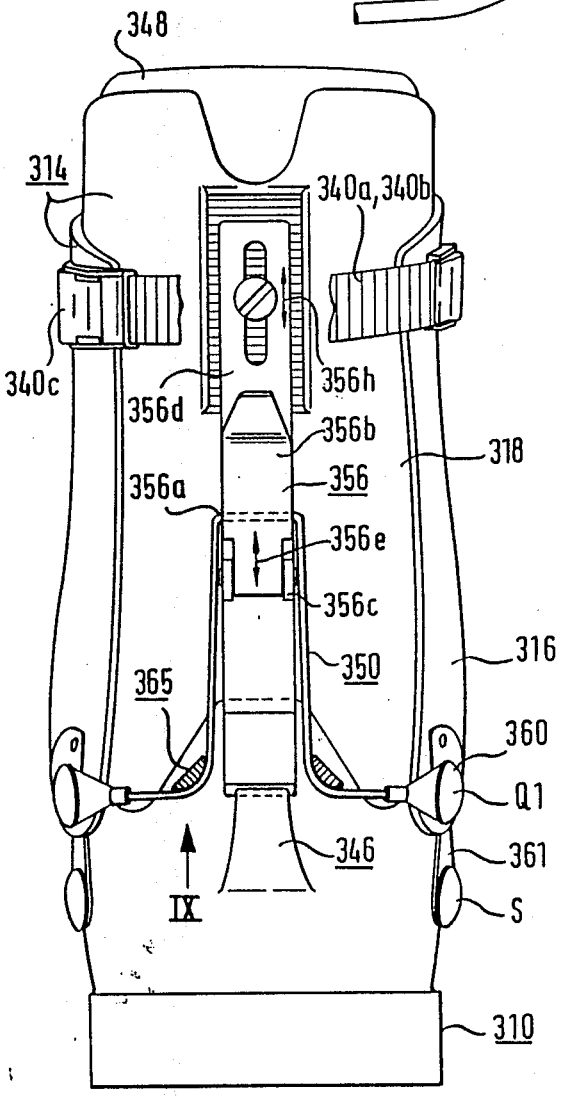
FIG. 8 represents a fourth form of embodiment in rear view, namely a modification of the form of embodiment according to FIGS. 4 to 7.
Figure 17:
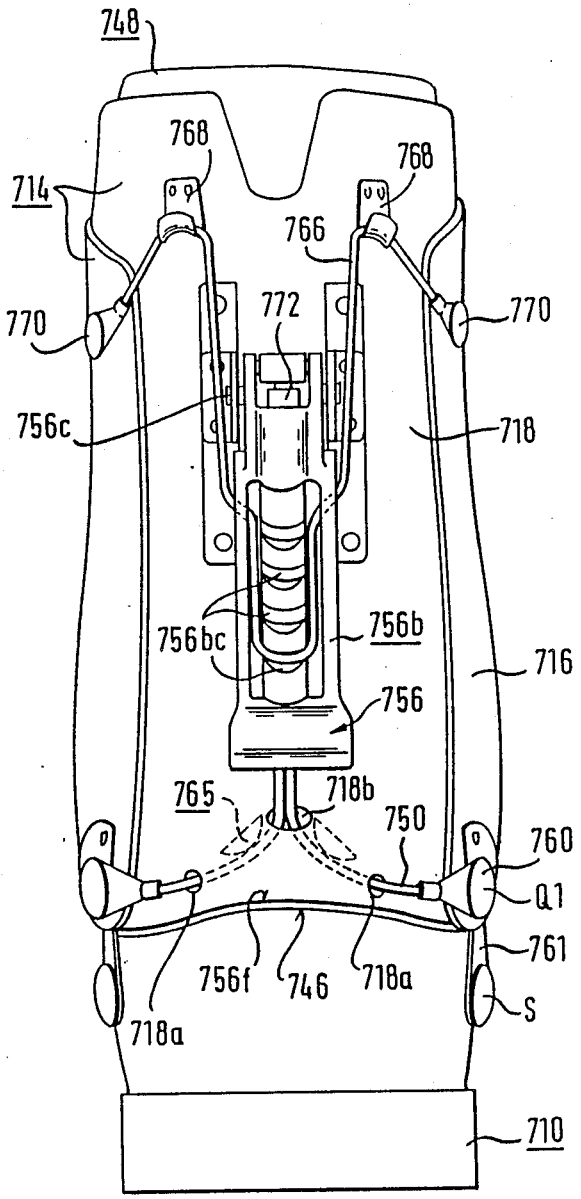
FIG. 17 represents a seventh form of embodiment.

The form of embodiment according to FIG. 17 corresponds in part to the forms of embodiment according to FIGS. 8, 10 and 11; analogous parts are provided with the same references as therein, in each case with addition of the first digit 7.

According to FIG. 17 the draw cables 750 extend partly beneath the anklet rear part 718. Coming through holes 718*a* from the anklet front part 716 they enter the interspace between the anklet rear part 718 and the toe- and heel-piece 710, are deflected by dogs 765 on the toe- and heel-piece and pass through a further hole 718*b* out of the anklet rear part 718 again. Thence they extend to the draw bar 772 which is illustrated individually in FIG. 11. It is also conceivable to fit the deflector dogs 765 on the anklet rear part 718.

The closing cable 766 can be hooked into different hook-in positions 756*bc* and thus varied in its effective length.

Figure 18:
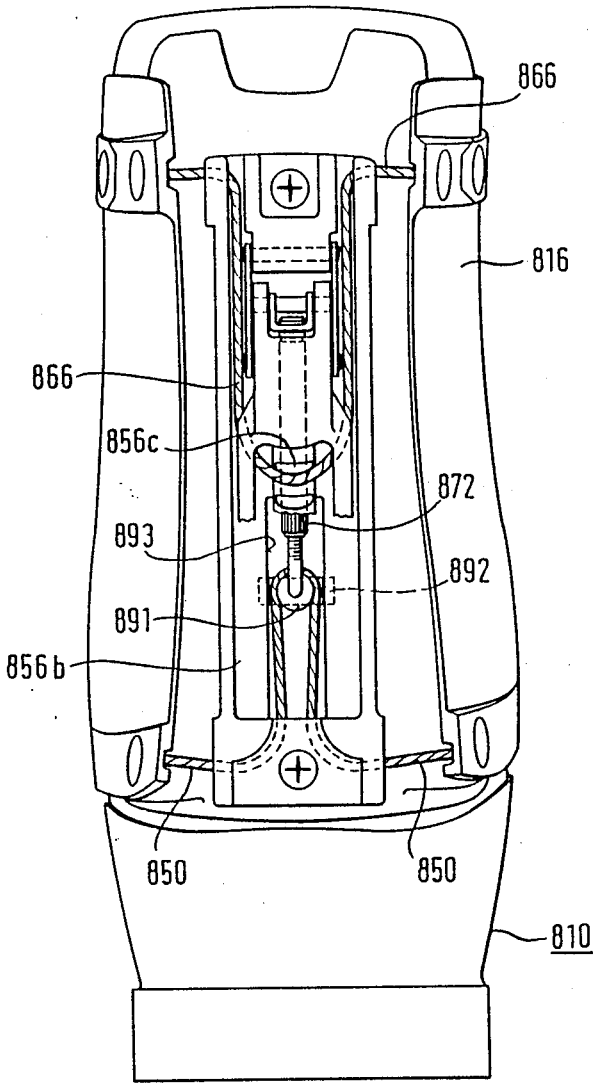
FIG. 18 represents an eighth form of embodiment of a ski boot from the rear.
Figure 19:
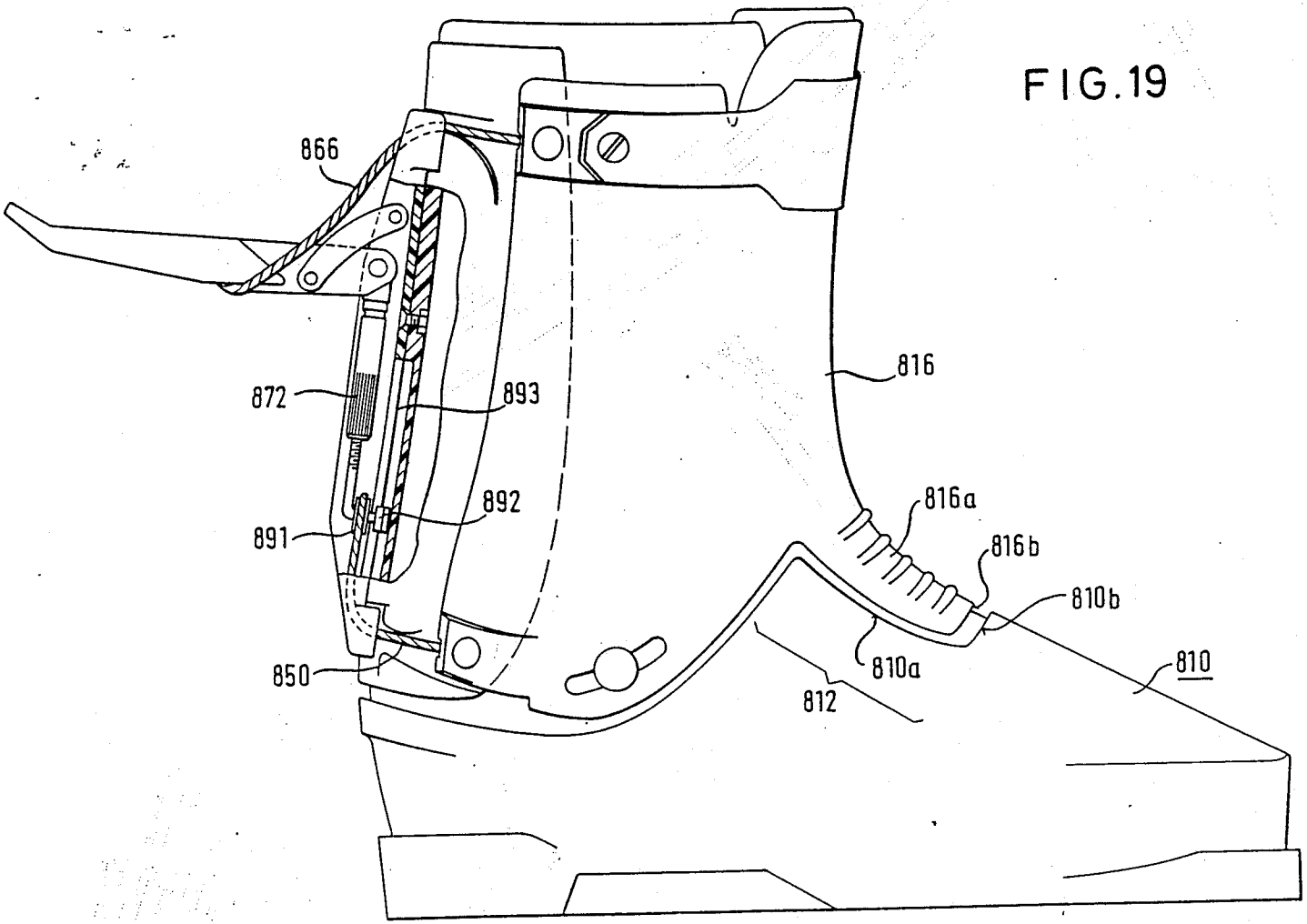
FIG. 19 represents the ski boot according to FIG. 18 from the side and partially in section and FIG. 20 represents a ninth form of embodiment from the side and partially in section.

In the form of embodiment according to FIGS. 18 and 19 the draw cable 850 extends over a compensator pulley 891 which is suspended on the draw bar 872 of variable length. The compensator pulley 891 as may be seen from FIG. 19, is secured on a slider 892 which is guided in a slider guide 893. The draw cable 866 can be hooked according to FIG. 18 into different hook-in positions 856*c* of the actuating lever 856*b*. Thus it is possible here again to regulate the tension in the draw cable 850 and in the draw cable 866 individually.

FIG. 19 shows in the instep region on the anklet front part 816 a spur 816*a* produced in one piece with the anklet front part 816, which spur is accommodated in a relief-type recess 810*a* of the instep region of the toe- and heel-piece 810 and is movable therein. This embodiment has the advantage that the pressure which the anklet front part 816 exerts in the instep region upon the instep upper surface of the toe- and heel-piece 810 is diminished steadily towards the free end of the spur 816*a*. Furthermore the relief-type recess 810*a* can influence the softness of the instep region 812. Finally the edges 816*b* and 810*b* of the spur 816*a* and the recess 810*a* form co-operating stops for a forward shift limitation of the ski boot.

Figure 20:
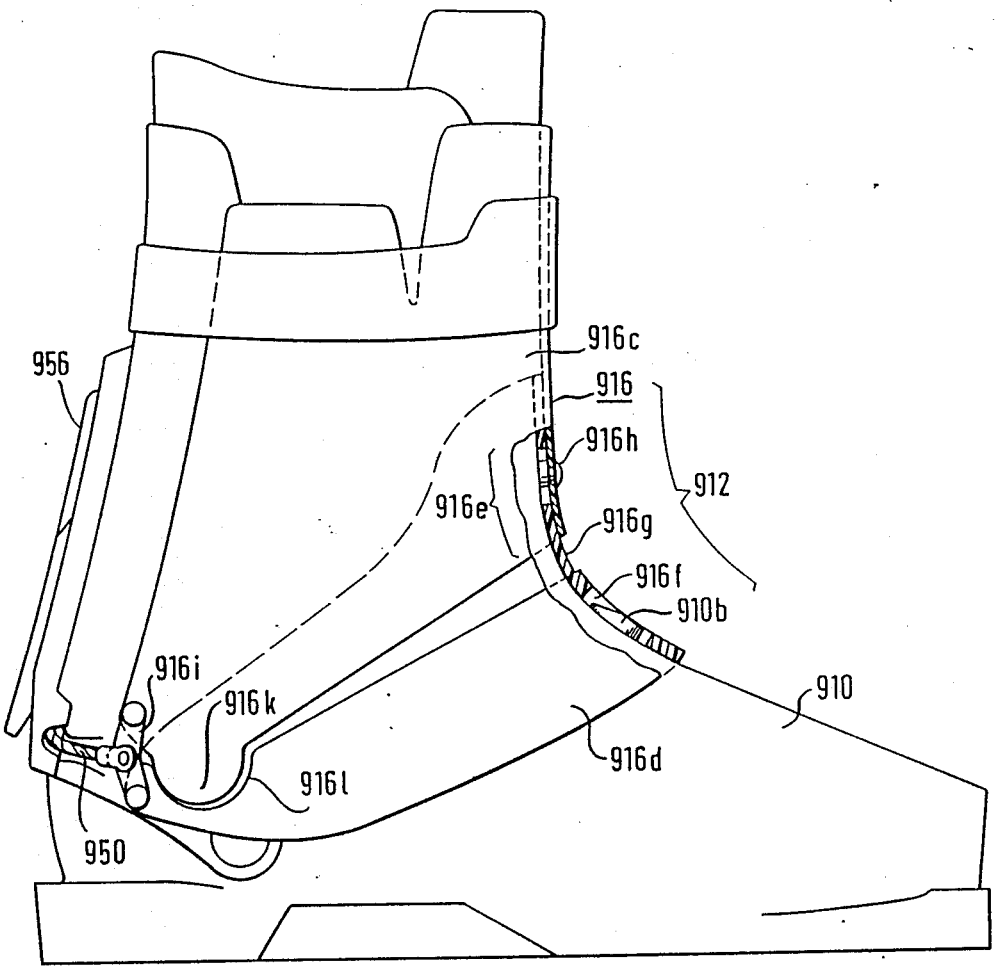

In FIG. 20 the anklet front part 916 is divided into two anklet front parts 916*c* and 916*d* lying one over the other in the manner of scales. These anklet front parts overlap in the region 916*e*. The anklet front part 916*d* has a guide slot 916*f* which displaceably receives a guide dog 910*b* of the toe- and heel-piece 910. The anklet front part 916*c* lies in the instep region 912 on a zone 916*g* of reduced wall thickness in relief manner of the anklet front part 916*d*. The two anklet front parts 916*c* and 916*d* are connected movably with one another by a slot-bolt connection 916*h*. The rearward parts of the anklet front parts 916*c* and 916*d* are connected with one another by means of a rocker beam 916*i*. The draw cable 950 engages with the rocker beam 916*i*. The two anklet parts 916*c* and 916*d* are arranged floatingly on the toe- and heel-piece 910, that is to say without a defined transverse axis Q1 according to FIG. 1. Rather when the draw cable 950 is tensioned the two anklet front parts 916*c* and 916*d* are secured in their position by the draw cable on the one hand and by the instep surface 912 on the other. The mobility of the anklet front parts 916*c* and 916*d* in relation to one another is ensured by an articulation head 916*k* and an articulation socket 916*e*.

What is claimed is:

1. A ski boot comprising:

(a) a toe-and-heel-portion having a sole portion and instep portion;

(b) an anklet front portion and an anklet rear portion; each of said two anklet portions being pivotally mounted on said toe-and-heel-portion, whereby said anklet portions are pivotally movable between an open position, which allows a person's foot to be inserted into the boot, and a closed position, in which said anklet portions may be brought together to close about a person's ankle;

(c) an upper closing device positioned on an upper portion of at least one of said two anklet portions; and (d) a lower tightening means positioned on a lower portion of at least one of said two anklet portions for applying a force against a person's foot located within said boot;

wherein said lower tightening means and said upper closing device comprise means that extend substantially horizontally across a back portion of said rear anklet portion.

2. The ski boot as defined by claim 1 wherein actuating said lower tightening means applies a force to the instep portion of a person's foot located in said boot.

3. The ski boot as defined by claim 1 wherein actuating said lower tightening means applies a force to the heel portion of a person's foot located in said boot.

4. The ski boot as defined by claim 1 wherein said upper closing device comprises a tension strap.

5. The ski boot as defined by claim 1 wherein said lower tightening means comprises a tension strap.

6. The ski boot as defined in claim 5 wherein said lower tightening means further comprises a buckle means for securing said tension strap.

7. A ski boot comprising:

(a) a toe-and-heel-portion having a sole portion and an instep portion;

(b) an anklet front portion and an anklet rear portion; each of said two anklet portions being pivotally mounted on said toe-and-heel-portion, whereby said anklet portions are pivotally movable between an open position, which allows a person's foot to be inserted into the boot, and a closed position, in which said anklet portions may be brought together to close about a person's ankle; and (c) a spur member extending downwardly from the anklet front portion for distributing forces applied on an instep portion of said boot when said anklet front portion is moved with respect to the toe-and-heel-portion.

8. The ski boot as defined in claim 7 wherein said spur member comprises means to distribute forces applied on said instep portion along a gradient.

9. The ski boot as defined in claim 8 wherein said spur member comprises a plurality of ribs that gradient forces that are applied to said instep.

10. The ski boot as defined in claim 7 further comprising a recess in which the spur is movably positioned.

11. The ski boot as defined in claim 10 wherein an edge of each of said spur member and said recess form a coacting stop means for limiting the forward movement of said anklet front portion.

12. A ski boot comprising:

(a) a toe-and-heel-portion having a sole portion and an instep portion;

(b) overlapping, movable connected first and second anklet front portions, one of said first and second anklet front portions and said toe-and-heel-portion having means adapted to cooperate with means on the other of said first and second anklet front portions for adjustment to an individual's foot;

(c) means to draw said first and second anklet front portions against an individual's located in said boot; and (d) an anklet rear portion, each of said first and second anklet front portions and said anklet rear portion being pivotally mounted on said toe-and-heel-portion.

13. The ski boot as defined in claim 12 wherein said first and second anklet front portions are connected together adjacent said anklet rear portion by a pivotal linkage means and said means to draw said first and second anklet front portions against an individual's foot comprises a tensioning means connected to said pivotal linkage means.

14. The ski boot as defined in claim 13 wherein said first and second anklet front portions comprise head and socket means positioned on said portions such that said first and second anklet front portions are floatingly arranged to be adapted to an individual's foot.

15. The ski boot as defined in claim 13 wherein said pivotal linkage means comprises a rocker means.

16. The ski boot as defined in claim 13 wherein said pivotal linkage means comprises an intermediate section and two end sections each pivotable about an axis located on said intermediate section.

17. The ski boot as defined in claim 16 wherein said axes about which said first and second anklet front portions pivot are located on said end sections of said pivotal linkage means.

18. The ski boot as defined in claim 13 wherein said pivotal linkage means comprises a two-armed link, pivotal about an axis intersecting said two arms.

19. The ski boot as defined in claim 18 comprising a support link pivotally mounted about an axis about which one of said end sections pivots.

* * * * *